United States Patent [19]

Maack

[11] 3,946,836

[45] Mar. 30, 1976

[54] ELEVATOR SYSTEM HAVING CO-MOVING AND SHORT-LENGTH ANNULAR-BELT FOR SUSPENDING AND PROPELLING THE CARRIAGE

[76] Inventor: Norris N. Maack, R.R. No. 3, Box 66, West Point, Nebr. 68788

[22] Filed: Nov. 25, 1974

[21] Appl. No.: 526,576

[52] U.S. Cl. ..... 187/8; 104/147 R; 182/141; 187/19

[51] Int. Cl.[2] ..... B66B 5/16; B66B 9/02

[58] Field of Search ..... 187/2, 6, 8, 9, 17, 20, 187/19, 22, 80, 73; 104/147 R, 165; 182/141, 148, 133

[56] References Cited

UNITED STATES PATENTS

| | | | |
|---|---|---|---|
| 373,853 | 11/1887 | Rich | 104/147 R |
| 3,381,541 | 5/1968 | Thireau | 187/17 X |
| 3,384,031 | 5/1968 | Dashew | 104/139 X |

FOREIGN PATENTS OR APPLICATIONS

| | | | |
|---|---|---|---|
| 8,868 | 5/1900 | United Kingdom | 187/19 |

*Primary Examiner*—Evon C. Blunk
*Assistant Examiner*—James L. Rowland
*Attorney, Agent, or Firm*—George R. Nimmer

[57] ABSTRACT

An elevator system with a carriage for moving a payload such as personnel or cargo traversely along a vertically lofty silo or other vertically elongated structural environment, the elevator system comprising a finite-length framework along which the vertically movable carriage through a guidable yoke slidably traverses and including at least one upright lugged-rail having laterally projecting horizontal lugs spaced at liberal-increments-intervals therealong. Confined to the carriage and wholly co-movable therewith is a crawling-propulsion assembly which includes a vertically elongated short-length tightenable annular-belt having regularly-spaced openings for removably securely engaging successive lug projections whereby the annular-belt linear leadward frontal-length suspendably supports and crawlably propels the loadable carriage along the framework upright lugged-rail. There is a dual-directional powering means such as, on the carriage, electrical motor and switch for selectively powering the annular belt in both directions for coincident directional movement of the carriage. In certain embodiments, detoothed sprockets are employable to drive the annular-belt.

8 Claims, 7 Drawing Figures

FIG. 1
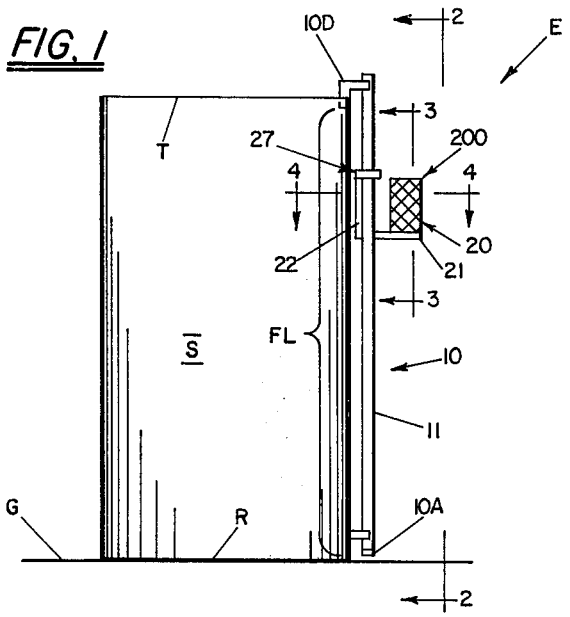
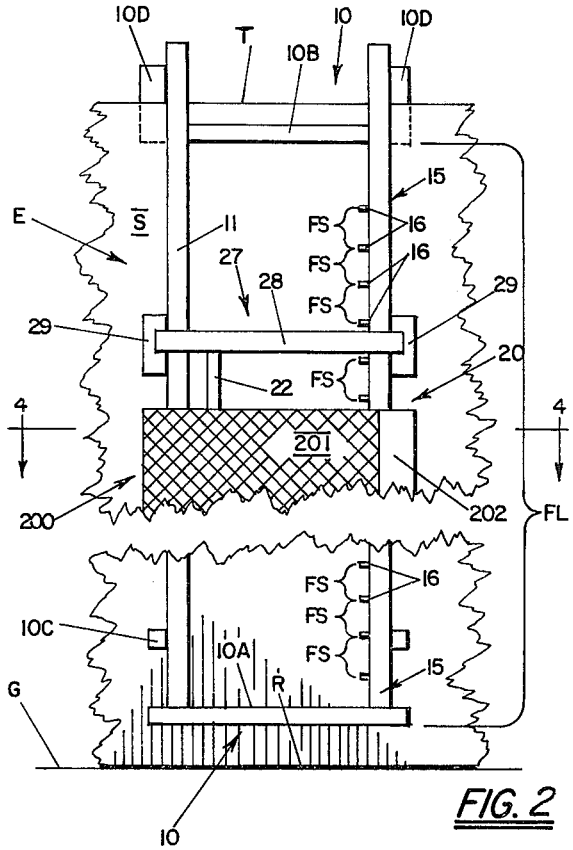
FIG. 2
FIG. 3
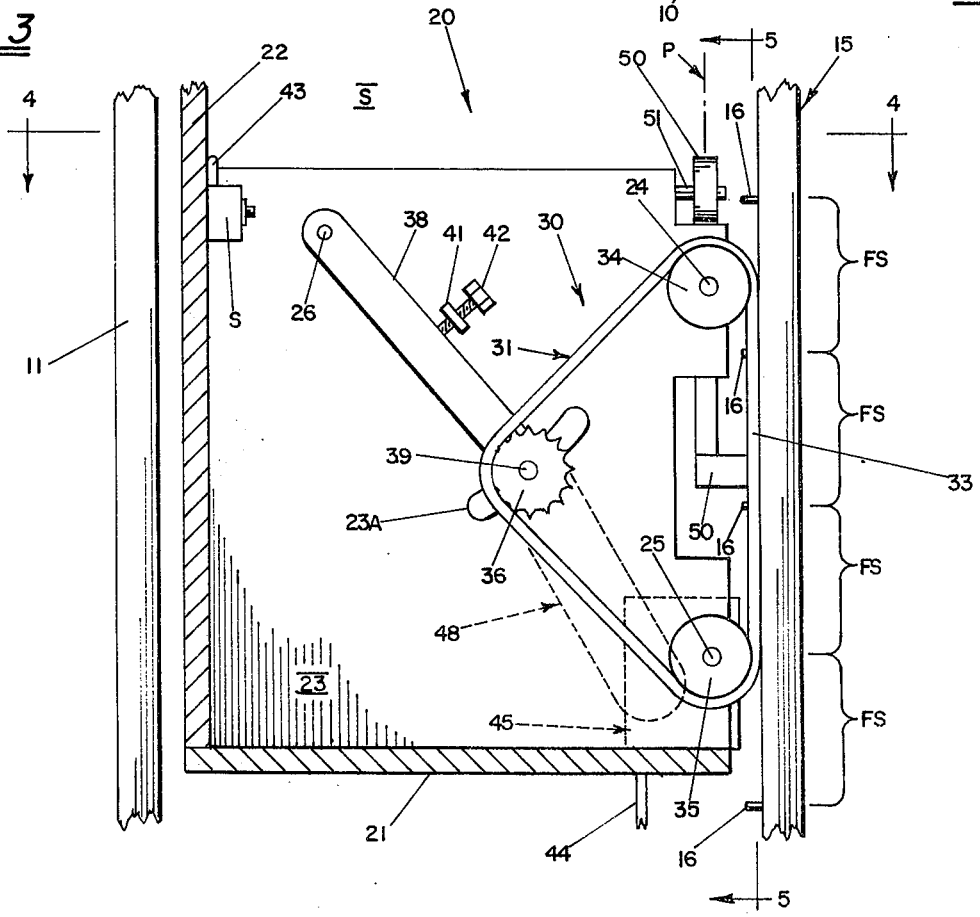

P
15
16
FS
FSS
23
24
25
26
34
36
37
38
39
41
42
45
46
136
137
138
21
S
5
3
10C
10A
11
22
43
44
47
48
50
51
52
53
30
31
32
33
G
E
200
201
202

ELEVATOR SYSTEM HAVING CO-MOVING AND SHORT-LENGTH ANNULAR-BELT FOR SUSPENDING AND PROPELLING THE CARRIAGE

Suspended and vertically movable elevator carriages are intended to vertically traverse some finite-length lofty framework of a vertically elongated structural environment such as a lofty farm silo or other towering stationary structure. For most such elevator systems of the prior art, the carriage is both suspended and vertically motivated through propulsion means normally including a very lengthy component such as moving cables, extendible hydraulic pistons, pinion racks, etc., which component at least equals the framework finite-length. Such exceedingly lengthy propulsion means necessarily require very elaborate safety means to prevent the carriage from falling or being precariously disabled should mis-function of the propulsion means occur, require overlydesigned and elaborate powering means and transmission for vertically moving the carriage, and (in part contributed by the very lengthiness exceeding the framework finite-length) usually require very heavy capital expenditures. Especially prevalent are these and other problems of elevator propulsion means as applied to outdoor structural environments wherein the elevator system is utilized along the exposed sides of agricultural structures such as farm silos, construction sites, and similarly lofty stationary environments.

It is the general object of the present invention to provide elevator systems that are economical to build, install, operate, and maintain, and that can be utilized in several environmental situations and desirably (through not limited to) for the particular exigiencies encountered with lofty towering farm silos.

It is another general object of the present invention to provide an elevator system that is adapted to traverse along a finite-length lofty framework wherein the means for both suspending and propelling the carriage comprises unusually short length components which bear only a very minor ratio as compared to the carriage traversable finite-length.

It is a further object to provide an elevator system that can be manufactured in a form that is relatively easily assembled and erected by relatively unskilled or semi-skilled persons.

It is another object to provide an elevator system that is of reliable and safe operation, and particularly for outdoor structural environments, such as at construction sites, agricultural installations, warehouse loading areas, etc.

It is a further object to provide an elevator system having an unusually low ratio of mass as compared to payload weights manipulatable and handlable by its moving carriage.

With the above and other objects and advantages in view, which will become more apparent as this description proceeds, the novel elevator system concepts herein generally comprise: a lofty framework including a lugged-rail with a finite-length thereof traversable by a carriage and having a plurality of laterally projecting horizontal lugs spaced at liberal-intervals, a platformed carriage vertically guidably associated along the frame through a yoke means, a crawling-propulsion assembly including at least two vertically spaced-apart roller type members attached to the carriage and for a short-length annular belt therearound, driving means for the annular belt including a driver-sprocket of the radial teeth type, at least one radial tooth of the driver-sprocket being purposely deleted whenever employed in the direct pathway of lugged-rail projecting lugs, regularly-spaced openings for the driven annular-belt and securely removably engageable with the said projecting lugs thereby both suspending and propelling the carriage, dual-directional powering means for powerably driving the annular belt in both directions controllably, anti-slack tightener means for the annular belt, and safety-catch means biased against the annular belt to catch a projecting lug and prevent falling or precariousness of the carriage should the annular belt misfunction or break.

In the drawing, wherein like characters refer to like parts in the several views, and in which:

FIG. 1 is a side elevational view of a representative embodiment elevator system of the present invention, shown in transversely offset and vertically movable relationship with a towering farm silo typical structural environment.

FIG. 2 is a sectional elevational view taken along line 2—2 of FIG. 1.

FIG. 3 is a sectional elevational view taken along lines 3—3 of FIGS. 1, 4, and 5.

FIGS. 1 and 2 illustrate a typical stationary structural environment for the elevator system concepts of the present invention (herein as elevator system embodiment E) in transversely offset combination with a lofty farm silo structure S. Tubularly cylindrical conventional farm silo S comprises a bottom end R securely anchored at the earth's surface G and a towering annular top-end T.

Figures 3A, 3B, 4:
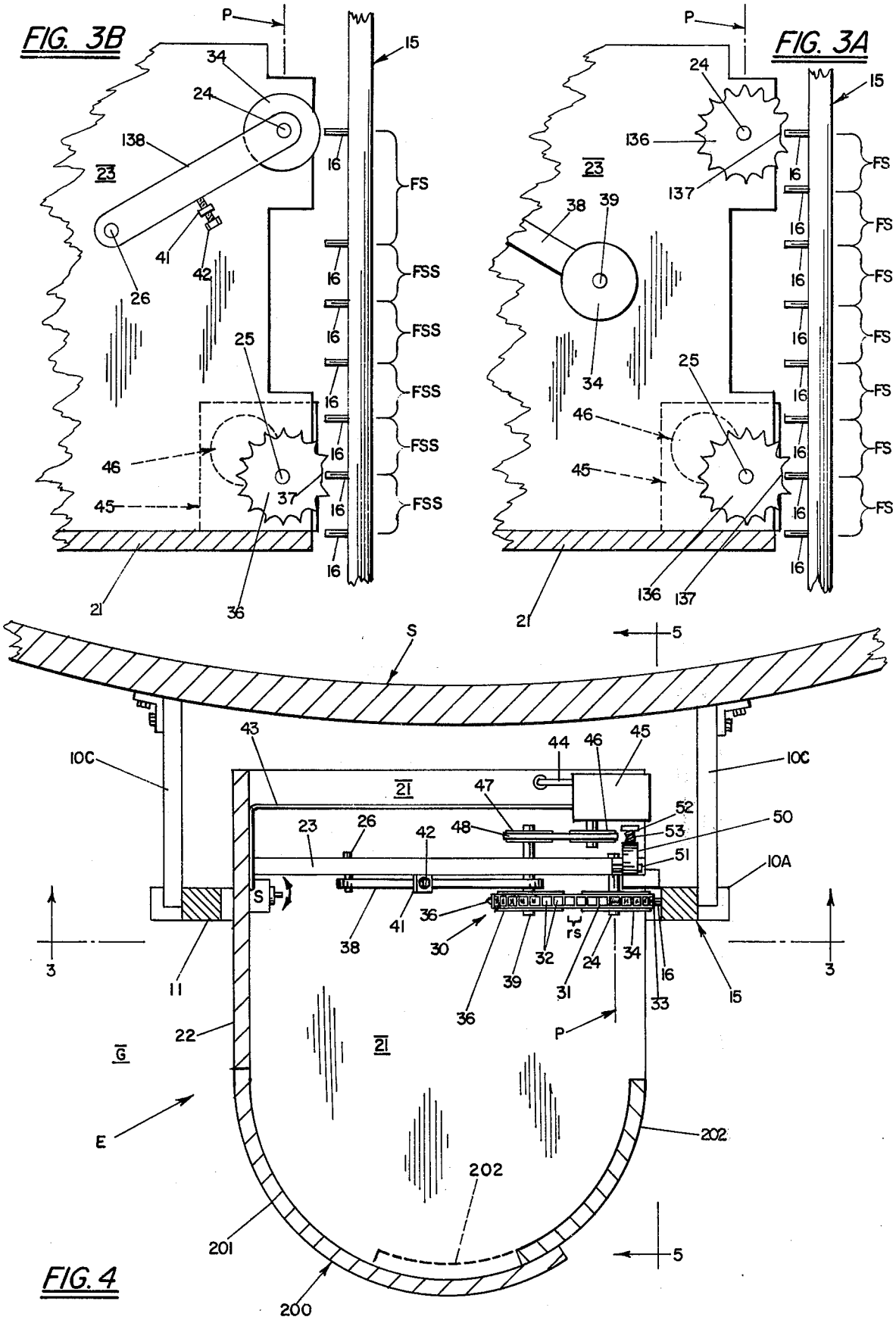
FIG. 4 is a sectional plan view taken along lines 4—4 of FIGS. 1, 2, and 5.
FIG. 3A is a sectional elevational view similar to FIG. 3, but devoid of the annular belt for clarity, to show an alternate type rollers system for supporting, driving, and tightening the annual belt.
FIG. 3B is a sectional elevational view similar to FIGS. 3 and 3A, and devoid of the annular belt, to show an alternate type rollers system for supporting, driving, and tightening the annular belt (not shown).

As alluded to in the several figures of the accompanying drawing, the lofty elevator system framework (e.g., 10) is attached to and is transversely offset from the structural environment therefor (e.g. farm silo S) and having a vertically linearly extending carriage-traversable finite-length FL defined by at least one lugged-rail 15. Herein the framework embodiment 10 has a regular lateral-width defined by two substantially parallel rails including a lug-free leftward rail 11 in addition to a lugged-rail 15. Rails 11 and 15 are attached (as by welding) at the silo top-end T with angular top brackets 10D and at the silo bottom-end R with bottom-brackets 10C. Also, rails 11 and 15 are herein rigidly spaced apart in parallel relationship with laterally extending bracer bars including top bar 10B and bottom bar 10A which aptly define therebetween the herein lineal finite-length FL. Rail 15 along the finite-length distance FL thereof includes a finite-number plurality of horizontally projecting lugs 16 spaced at liberal-increments-intervals (e.g. FS, FSS) between the lugs, herein as identical lugs 16 which project inwardly toward leftward rail 11. The liberal-increments (FS, FSS) between lugs 16 bears an integral multiple of the annular-belt (e.g. 31) openings spacings dimensional value (rs) which multiple is preferably at least eight. The liberal-intervals are preferably regular FS. Thus, the projecting lugs 16 lugged-rail differs from a so-called conventional rack for combination with a conventional pinion.

There is a platformed carriage, indicated generally as 20, which is vertically movably associated along the framework 10 through an appropriate yoke means portion 27 that restrains the carriage in the transverse and lateral directions with respect to the upright framework. Herein, the linear parallel rails 11, 15 framework acts as a guide means for a collar-like yoke means 27 vertically slidable therealong, the yoke embodiment 27 comprising four inter-connected members slidably surrounding parallel rails 11 and 15 including two lateral horizontal bars 28 and two tranverse horizontal bars 29. Extending vertically rigidly uprightly from the carriage horizontal platform deck 21 and connected to yoke 27 is a transverse panel 22. There is a lateral panel 23 extending rigidly uprightly from carriage platform deck 21 and connected to (but of shorter height than) transverse panel 22. Platformed carriage 20 is desirably provided with an upright guard means 200 to ensure against a passenger from falling thereoff and including a closable door portion to permit passenger entrance to the platformed carriage. Herein, guard means embodiment 200 includes a curvilinear upright stationary reticulated main portion 201 extending rigidly upwardly of platform deck 21 and a curvilinear upright door portion 202 slidably associated therewith.

Figure 5:
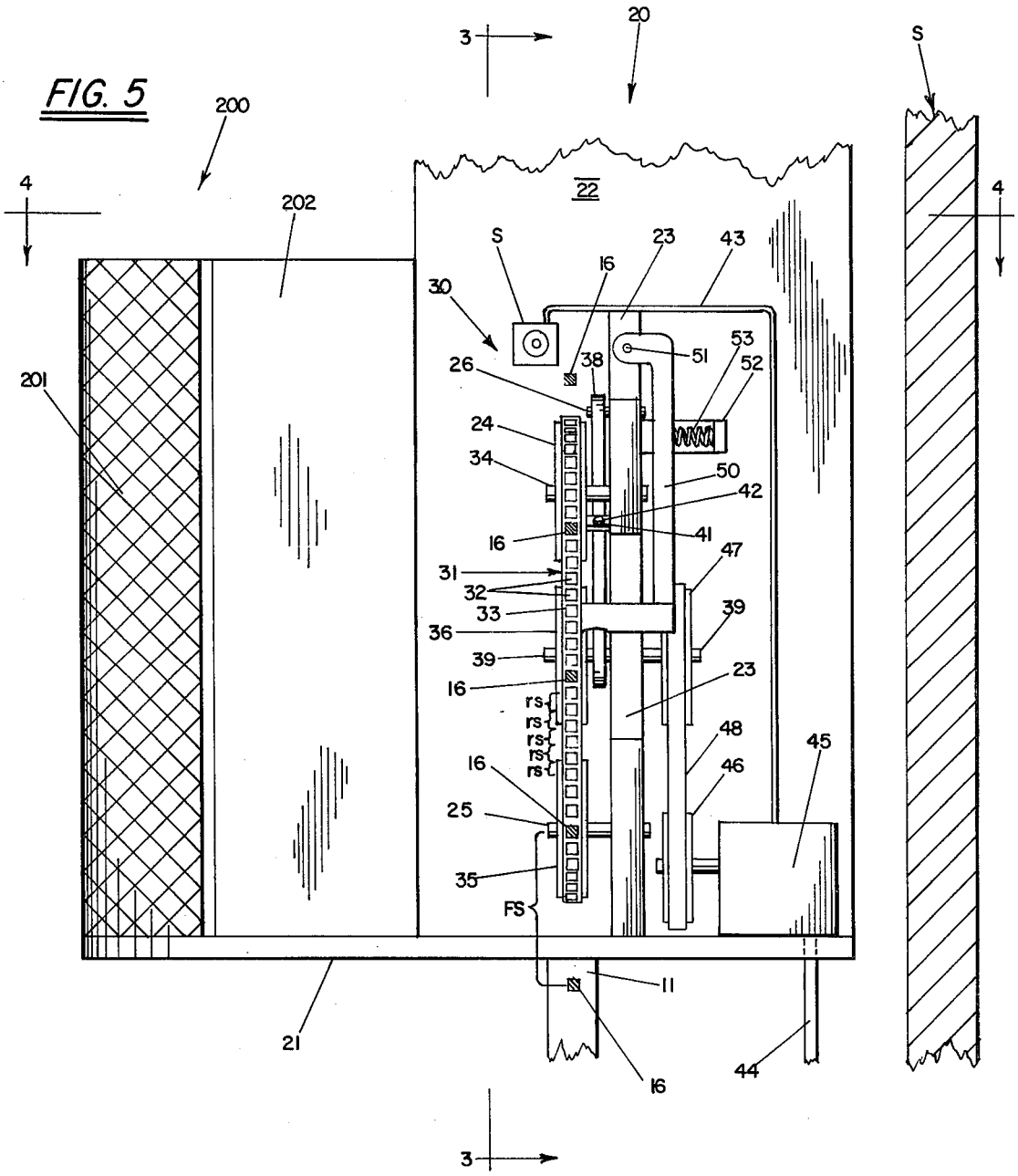
FIG. 5 is a sectional elevational view taken along lines 5—5 of FIGS. 3 and 4.

There is a crawling propulsion assembly, generally indicated as representative embodiment 30 thereof in FIGS. 3-5, for both suspending and vertically propelling (selectively "up" or "down") the carriage 20 along the lugged 16 vertical framework. As is seen, the entire weight of the crawling propulsion assembly 30 is carried by and is directly co-movable with the platformed carriage 20 and necessarily comprises a vertically elongated shortlength flexible annular-belt 31 having regular-spaced (rs) openings or apertures for successively removably securely engaging the lugged-rail lugs 16. Although flexible annular belts might include a multi-link metallic chain having conventional regular-spacing between identical open links, the annular belt embodiment 31 conveniently is of the simplified structurally continuous form of FIGS. 3–5 having apertured openings or holes 32 with regular-spacing rs therebetween. The number of regularly-spaced lugs-engaging openings 32 for flexible annular belt 31 is typically less than one hundred.

The shape of the annular belt is at least partially defined by at least two belt-surrounded roller type members which respectively surround generously vertically separated horizontal internal axes for the annular belt (e.g. shaft 24 as an upper axis, shaft 25 as a lower axis) which axes lie along a common vertical plane P. The term roller type members is sufficient to include conventional flanged pulleys (e.g., 34, 35) and also both conventional and modified sprockets (e.g., 36, 136) of the radial teeth type. It will be seen that the belt annular shape in FIGS. 3 and 3A is generally triangular and in FIG 3B is substantially oval. In the FIGS. 3 and 3A embodiments shafts 24 and 25, which provide the upper axis and the lower axis along vertical plane P, are attached at fixed elevations to lateral panel 23. The annular belt includes a lineal leadward-frontal-length 33 extending in vertical elevation between said co-planar axes 24 and 25 and lying parallel alongside the lugged rail 15. The frontal-length 33 vertically exceeds the lugs' liberal-interval spacing and thereby simultaneously removably securely engages at least two laterally projecting lugs 16.

There is driving means for the short-length upright annular belt 31 and including a driver-sprocket (e.g. 36) of the radial teeth type. Thus, as the lugs-engaging annular belt 31 is controlled to move in the respective angular directions with respect to the co-planar axes (e.g. 24 and 25), the platformed carriage 20 is motivated in the "up" and "down" directions with respect to the lugged framework 10. There is necessarily anti-slack tightening means for the annular belt, which in the FIG. 3 embodiment comprises mounting the driver-sprocket onto an elongate pivotal arm 38 with central shaft 39, elongate arm 38 being pivotably attached to lateral panel 23 with pivot pin 26. Thus, driver-sprocket 36 is spaced in elevation between axes 24 and 25 and is in laterally inwardly offset relationship with respect to vertical plane P. There are means for adjustably moving and stabilizing this third (e.g. laterally offset) roller type member (e.g. driver-sprocket 36) away from vertical plane P, as by adjusting screw 42 bearing against arm 38 and which screw 42 is threadedly engaged with an integral boss portion 41 of lateral panel 23. Thus, the driver-sprocket third roller member 36 is adjustably movable inwardly of vertical plane P to function as an anti-slack tightening means. Lateral panel 23 is providable with an upwardly extending arcuately slotted portion 23A through which adjustably movable shaft 39 horizontally passes.

There is dual-directional powering means for powerably rotating a driver-sprocket (e.g., 36, 136) controllably (e.g., switch S) in both angular directions thereby selectively "upwardly" and "downwardly" propelling the carriage 20 through the lugs-engaging annular-belt 31. Herein, the powering means includes an electric motor 45 mounted upon carriage platform deck 21 and which is dualdirectional e.g. motor shafted pulley 46 is capable of being selected (S) for rotation in both angular directions. Preferably, the voltage for electric motor 45 is supplied from earth-level G through an elongate flexible electrical cord 44 extendible along traversable finite-length FL. The angular direction of motor pulley 46 and hence carriage "upward" or "downward" travel direction is determined by two-positions electric switch S mountable on transverse panel 22 and thereby manually accessible for control by a carriage passenger. However, the switch S might be stationarily located as at earth level G, if the carriage is to be devoted solely for cargo. Herein, the central shaft 39 (horizontally passing through lateral panel slot 23A) carries a pulley 47 which is made co-revolvable with electric motor powering means 45, through transmission belt 48.

Safety-catch means are employed to catch against a rail lug 16 to prevent the vertically movable carriage 20 from falling or other danger in the contingency of annular belt breakage or mis-function. In this vein, the safety-catch means is continuously biased against the annular belt. The safety-catch means herein illustrated comprises an L-shaped member 50 pivotally attached with lateral pin 51 to the upper end of lateral panel 23. There is a compression helical spring 53 connected to lateral panel finger 52 which biases depending member 50 to continuously ride against the operating annular belt 51.

In the alternate crawling propulsion systems of FIGS. 3A and 3B, the driver-sprocket surrounds lower axis 25, and hence, at co-elevation with motor shaft pulley 46 whereby the transmission-belt required in FIGS. 3A and 3B is horizontal and shorter than the upwardly laterally extending elongated transmission belt of FIG. 3. Nor is the FIG. 3 lateral panel slot 23A required for the FIGS. 3A and 3B embodiments. The shorter and horizontal transmission-belt and the very close proximity of the driver-sprocket to the rail lugs 16 for the FIGS. 3A and 3B embodiments provide a more affirmative and efficient driving and powering means combination. Because of the very close proximity of the driver-sprocket to the sequentially encountered lugs 16, at least one (but not exceeding a minor proportion) of the radial teeth for the driver-sprocket is purposely deleted therefrom. The deleted tooth or teeth is empirically selected to synchronizably coincide with the sequentially encountered lugs 16. This synchronization of a deleted tooth position 137 is shown relative to driver-sprocket 136 in FIGS. 3A and 3B. In the FIG. 3A embodiment, second and third type roller members utilized include a similarly detoothed 137 idler-sprocket 136 surrounding co-planar (P) upper axis horizontal shaft 24 and a flanged pulley 34 revolvably 39 secured to the adjustable pivotal arm 38. In the FIG. 3B embodiment, upper axis horizontal shaft 24 passes through adjustably positional pivotal arm 138 rather than through lateral panel 23.

From the foregoing, the construction and operation of the elevator system having co-moving short-length annular belt will be readily understood and further explanation is believed to be unnecessary. However, since numerous modifications and changes in the elevator system will readily occur to those skilled in the art, it is not desired to limit the invention to the exact constructions shown and described, and accordingly, all suitable modifications and equivalents may be resorted to, falling within the scope of the appended claims.

I claim:

1. In combination with a towering farm silo and analogous vertically lofty stationary structural environment, an elevator system for traversing a finite-length distance along said structural environment and comprising:

A. A lofty framework attached to and transversely offset of the structural environment and having along a vertically linearly extending finite-length distance thereof a lateral width defined by a pair of substantially parallel upright rails, at least one of said upright framework rails being a lugged-rail having along a finite-length distance a finite-number plurality of identical horizontally laterally projecting lugs spaced at liberal-increments which represents an integral multiple of a regular-spacing dimensional value;

B. A platformed carriage vertically movably associated along the framework through a connected yoke means that restrains the carriage in the transverse and lateral horizontal directions with respect to said upright rails as a carriage guide means;

C. A crawling-propulsion suspension assembly for both suspending and vertically propelling the carriage with respect to the lofty framework, the entire weight of the crawling propulsion assembly being carried by and directly vertically co-movable with the platformed carriage and comprising:

i. A vertically elongated short-length annular belt having lugs-engageable openings spaced at a regular-spacing dimensional value therealong, the annular shape being at least partially defined by at least two roller type members respectively surrounding vertically separated horizontal internal axes which lie along a common vertical plane including an upper axis and a lower axis, the annular belt having a lineal frontal-length extending in vertical elevation between said co-planar axes and lying parallel alongside the lugged-rail and having a vertical length sufficiently to simultaneously removably engage at least two laterally projecting lugs;

ii. driving means for the short-length annular belt and including a driver-sprocket type roller member having teeth engaged with the short-length annular belt;

iii. anti-slack tightening means for the annular belt, and iv. dual-directional powering means for powerably rotating said driver-sprocket and controllable in both angular directions thereby propelling the carriage through the carried annular belt selectively upwardly and downwardly along the lugged-rail; and D. Safety-catch means biased against the annular belt to catch against a lugged-rail lug in the contingency of annular belt mis-function.

2. The combination of claim 1 wherein the finite-number lugs plurality are spaced at regular liberal-increments along and laterally inwardly project from the lugged-rail toward the other framework rail; wherein the liberal-intervals represents an integral multiple of at least eight with respect to the regular-spacing of lugs-engageable openings; and wherein the number of annular belt lugs engageable openings is less than 100.

3. The combination of claim 2 wherein the driver-sprocket is spaced in elevation between the two horizontal axes of the annular belt and is inwardly laterally offset from the said common vertical plane.

4. The combination of claim 1 wherein a roller type member surrounding one of the co-planar horizontal axes for the annular belt is a driver-sprocket having a central shaft, said driver-sprocket having at least one radial tooth purposely deleted whereby the driver-sprocket can pass by the lugged-rail projecting lugs.

5. The combination of claim 4 wherein the second roller type member is a centrally shafted roller type member as an idler-sprocket surrounding the second of the co-planar horizontal axes whereby said annular-belt surrounds both sprocket type roller members, said second sprocket roller too having at least one empirically selected radial tooth purposely deleted therefrom whereby both the idler-sprocket and the driver-sprocket can pass by the lugged-rail projecting lugs.

6. The combination of claim 5 wherein the finite-number lugs plurality laterally inwardly project from the lugged-rail, there being an inter-lugs liberal-interval representing an integral multiple of at least eight with respect to the annular belt lugs-engaging openings dimensional value; wherein the anti-slack tightener means comprises a third roller type member spaced in elevation between the two coplanar horizontal axes and is inwardly laterally offset from the said common vertical plane, the annular belt passing around the three roller type members and thereby having a generally triangular shape, the third roller type member being carried by an elongated pivotal arm which arm is adjustably movable and stabilizable with respect to the co-planar horizontal axes.

7. The combination of claim 4 wherein the platformed carriage is provided with a rigidly upward lateral panel, the driver-sprocket cental shaft being attached at fixed elevation to said lateral panel, said lateral panel being provided with an upwardly extending slotted portion located laterally inwardly of said common vertical plane and the driver-sprocket central shaft; wherein the anti-slack tightener means comprises a third roller type member having a central horizontal shaft intersecting the lateral panel upright slot, together with means for adjustably moving and stabilizing the third roller type member away from said vertical plane, the annular belt passing around the three roller type members and thereby having a generally triangular shape; and wherein the dual-directional powering means includes a dual-directional electric motor attached to and vertically co-movable with the carriage, said electric motor being actuatably connected to the driver-sprocket, there being an "up" and "down" electric switch control means on the carriage maniplulatable by a passenger thereon.

8. The combination of claim 1 wherein the platformed carriage is provided with an upright guard to prevent a riding passenger from falling off, the guard means beinng provided with a closable door portion for passenger entrance to the platformed carriage; and wherein the "up" and "down" directional control for the annular belt powering means is located at and co-movable with the platformed carriage for control by a passenger thereat.

* * * * *